United States Patent [19]

Rowley et al.

[11] 3,958,894

[45] May 25, 1976

[54] FLUID PUMPING ASSEMBLY OF A MOLDED SYNTHETIC MATERIAL

[75] Inventors: William N. Rowley, Palos Verdes Estates; Gordon F. Ehret, Alhambra, both of Calif.

[73] Assignee: Weil-McLain Co., Inc., El Monte, Calif.

[22] Filed: Jan. 22, 1975

[21] Appl. No.: 543,060

[52] U.S. Cl. ..... 415/53 R; 415/200; 415/170 A; 415/121 G

[51] Int. Cl.[2] ..... F04D 9/02; F04D 29/40

[58] Field of Search ..... 415/53 R, 214, 121 G, 415/197, 200

[56] References Cited

UNITED STATES PATENTS

| | | | |
|---|---|---|---|
| 3,145,912 | 8/1964 | Weis | 415/122 R |
| 3,146,722 | 9/1964 | Warman | 415/197 |
| 3,155,045 | 11/1964 | Lown et al. | 415/197 |
| 3,375,789 | 4/1968 | Easton | 415/200 |
| 3,381,617 | 5/1968 | Wright | 415/197 |
| 3,416,456 | 12/1968 | Pollak et al. | 415/53 |
| 3,513,977 | 5/1970 | Bellinson | 210/94 |
| 3,594,102 | 7/1971 | Oden | 417/423 R |
| 3,656,861 | 4/1972 | Zagar | 415/197 |
| 3,664,760 | 5/1972 | Reiner | 415/214 |
| 3,685,919 | 8/1972 | Speck et al. | 415/197 |
| 3,773,432 | 11/1973 | Chow et al. | 415/152 A |
| 3,826,589 | 7/1974 | Frank et al. | 415/170 A |
| 3,829,238 | 8/1974 | Speck | 415/197 |

*Primary Examiner*—Henry F. Raduazo
*Attorney, Agent, or Firm*—Lane, Aitken, Dunner & Ziems

[57] ABSTRACT

A fluid pumping assembly in which an electrically operated motor is operatively connected to an impeller disposed in a volute housing. The volute housing is formed of two portions of a molded synthetic material which are joined together and which have rib means integrally formed on their inner faces for defining a priming chamber in the volute housing. A seal plate of a dielectric material extends within the volute housing and defines an opening for receiving drive means for the impeller.

9 Claims, 5 Drawing Figures

FIG. 3.
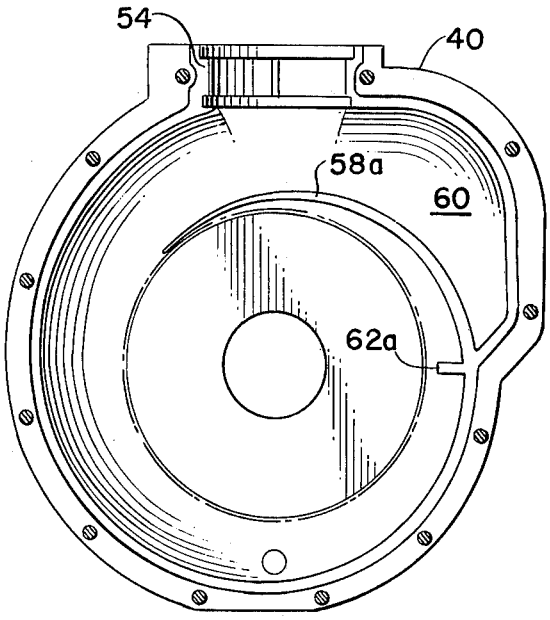
FIG. 4.
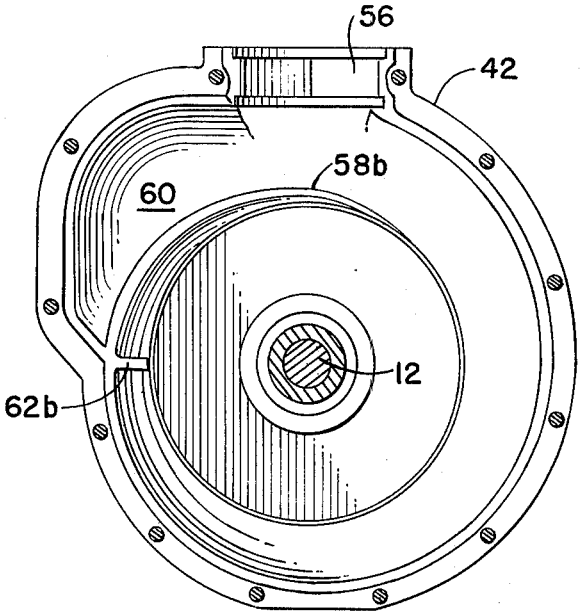
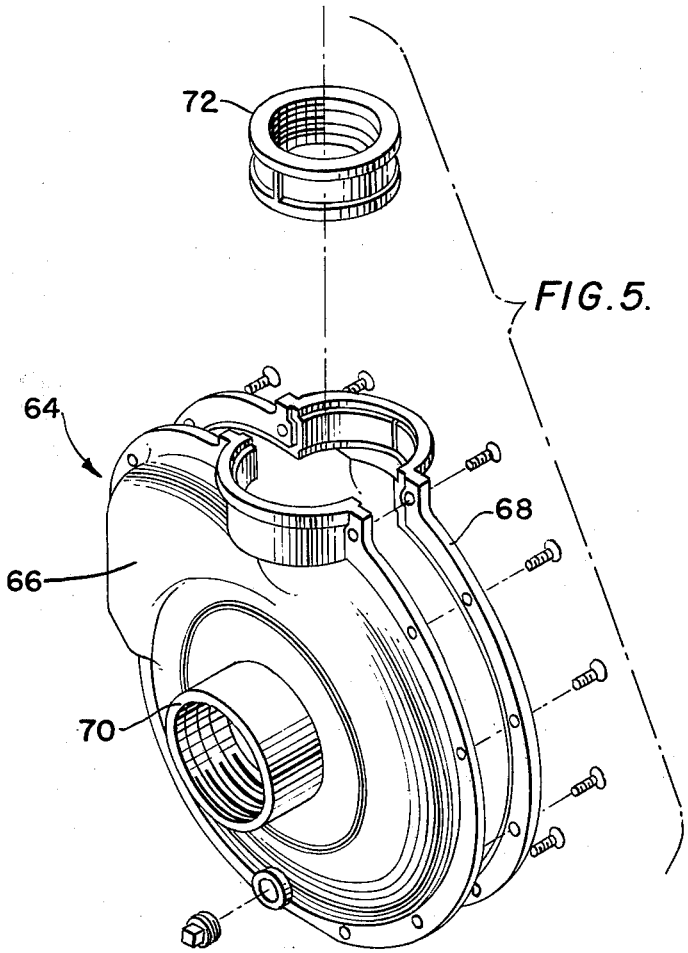
FIG. 5.

FLUID PUMPING ASSEMBLY OF A MOLDED SYNTHETIC MATERIAL

BACKGROUND OF THE INVENTION

This invention relates to a pumping assembly and, more particularly, to a pumping assembly which is driven by an electrical motor for pumping a liquid such as water.

Electrically driven water pumps for use in systems in which persons physically contact the water in the system, such as in swimming pools, household water systems, lavatories, and the like, present potential safety hazards. This is largely due to the fact that any breakdown in the internal insulation of the motor can impart an electrical voltage to the output shaft of the motor which can be conducted through the shaft, the mounting bracket for the pump and motor, and the pump housing to the electrical conductive water supply.

Although various techniques have been proposed to insulate the drive shaft from the water in the system, these solutions have been less than completely effective. Also, even in situations where the output shaft of the electrical motor is effectively insulated from the water, a hazard still exists due to the possibility of current leaking from the motor and through the pump housing to the water.

Although some recent designs have formed one or more of the components of such assemblies of a synthetic, dielectric material, such as plastic, the relatively intricate shape and arrangement of several of the individual components make it especially difficult to form them with the degree of precision that is required for optimum operation.

SUMMARY OF THE INVENTION

It is, therefore, an object of the present invention to provide a pumping assembly which eliminates the above problems by effectively insulating the electrical motor from the pump housing, and therefore, from the water contained in the housing.

It is an additional object of the present invention to provide a pumping assembly of the above type in which the critical components of the assembly are formed of a synthetic, dielectric material.

It is a further object of the present invention to provide a pumping assembly of the above type in which a volute housing is provided which has an internally formed rib for defining a priming chamber, with the housing and the rib being formed of a synthetic, dielectric material.

It is a still further object of the present invention to provide an assembly of the above type in which a seal plate is provided which is of a synthetic, dielectric material, and which is in an operative relationship with the volute housing to receive the drive means for the impeller and to support a seal assembly for the drive means.

Towards this end, the assembly of the present invention comprises two casing portions of a molded synthetic material joined together and defining a pumping chamber having a circular crosssection, one of the casing portions having an axially extending inlet opening to the chamber and the other of the casing portions defining a central opening, both of the casing portions defining a radially extending outlet opening from the chamber, impeller means in the chamber for forcing water from the inlet, through the chamber and out the outlet, a seal plate of a dielectric material extending within the central opening and defining an opening for receiving drive means for the impeller, seal means cooperating with the drive means and the seal plate for preventing the leakage of fluid from the housing, and rib means integrally formed on the inner face of at least one of the casing portions for defining a priming chamber adjacent the pumping chamber.

BRIEF DESCRIPTION OF THE DRAWINGS

FIGS. 3 and 4 are enlarged sectional views taken along the lines 3—3 and 4—4, respectively, of FIG. 1; and FIG. 5 is an enlarged, exploded perspective view of an alternate embodiment of a component of the assembly of FIG. 1.

DESCRIPTION OF THE PREFERRED EMBODIMENTS

Figure 1:
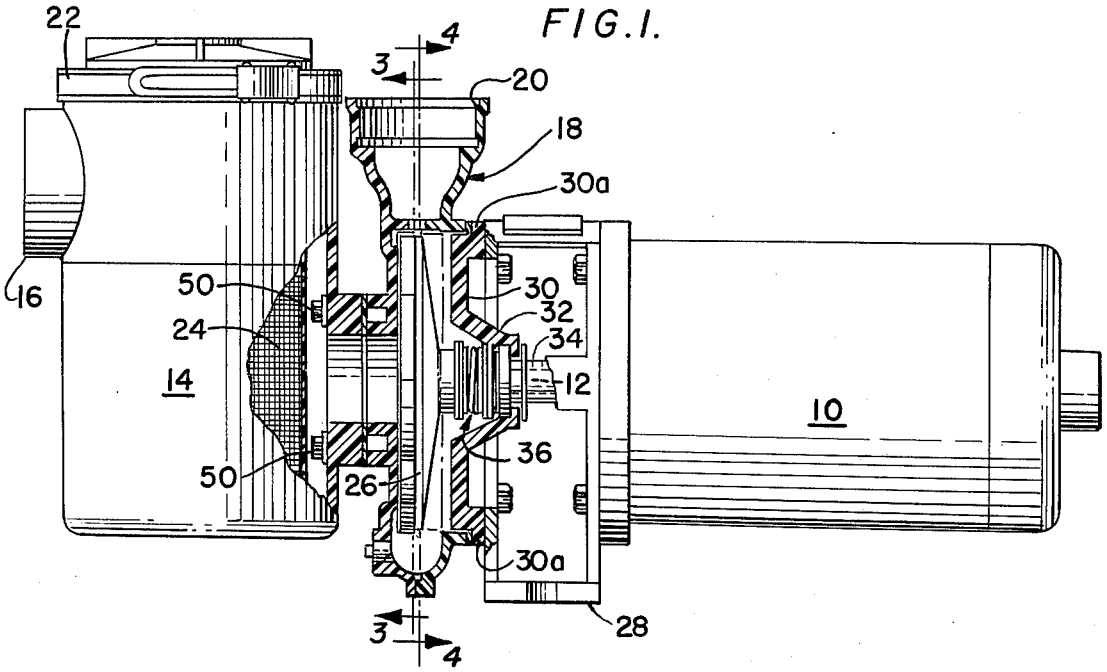
FIG. 1 is a partial elevational, partial sectional view depicting the pump assembly of the present invention.

Referring to FIG. 1, the reference numeral 10 refers in general to an electrically-operated motor having an output shaft 12 and being adapted to operate in a conventional manner in response to an electrical input to drive the shaft. A housing 14 is provided, which has an inlet 16 for receiving the liquid to be pumped and which registers with a volute, or pumping, housing 18 having a discharge port 20 for discharging the liquid. A lid 22 is provided on the top of the housing 14, and a filter basket 24 is provided in the housing.

An impeller 26 is provided in the volute housing 18 and is adapted to pump the liquid from the inlet 16 through the housing 14, and into and through the volute housing 18 from which it discharges through the discharge port 20. It is understood that pipes, hoses, or the like, may be connected to the inlet 16 and the port 20 to receive and discharge the liquid in a conventional manner.

A metallic mounting bracket 28 extends between, and is bolted to, the volute housing 18 and the motor 10 to support the motor relative to the housing. A seal plate 30 has an outer peripheral portion extending within an opening formed in the volute housing 18 and flange portions 30a extending between the mounting bracket 26 and the pump housing. The seal plate 30 also has a hub portion 32 provided with a central opening which receives the output shaft 12 of the motor 10. The housing 14, the basket 24, the volute housing 18, the impeller 26, and the seal plate 30 are all formed of a synthetic dielectric material.

The specifics of the mounting bracket 28 and the seal plate 30, along with the particular manner in which they are mounted relative to one another and to the volume housing 18 and the motor 10, will not be described in any further detail since they are fully described in U.S. patent application Ser. No. 509,121, filed on Sept. 25, 1974, by the present inventors, and assigned to the same assignee as the present invention. However, for the purposes of the present application, it should be noted that a plurality of insulating sleeves (not shown) extend around the shank portion of the bolts connecting the mounting bracket 28 to the volute housing 18, with the shank portions and the sleeves extending through the flange portions 30a of the seal plate 30, thus providing a complete insulation of the water in the volute housing 18 from the metalic support bracket 28. This is fully described in the above-identified application, the disclosure of which is hereby incorporated by reference.

An extension shaft 34 extends over a portion of the output shaft 12 and operatively connects the latter shaft to the impeller 24, and a seal assembly, shown in general by the reference numeral 36, extends over a portion of the extension shaft to seal same from the water in the volute housing 18. The extension shaft 34 and the seal assembly 36 are fully described in U.S. patent application Ser. No. 525,099, filed on Nov. 19, 1974 now U.S. Pat. No. 3,914,072, by the present inventors and assigned to the same assignee as the present invention. The disclosure of this application is also hereby incorporated by reference.

Figure 2:
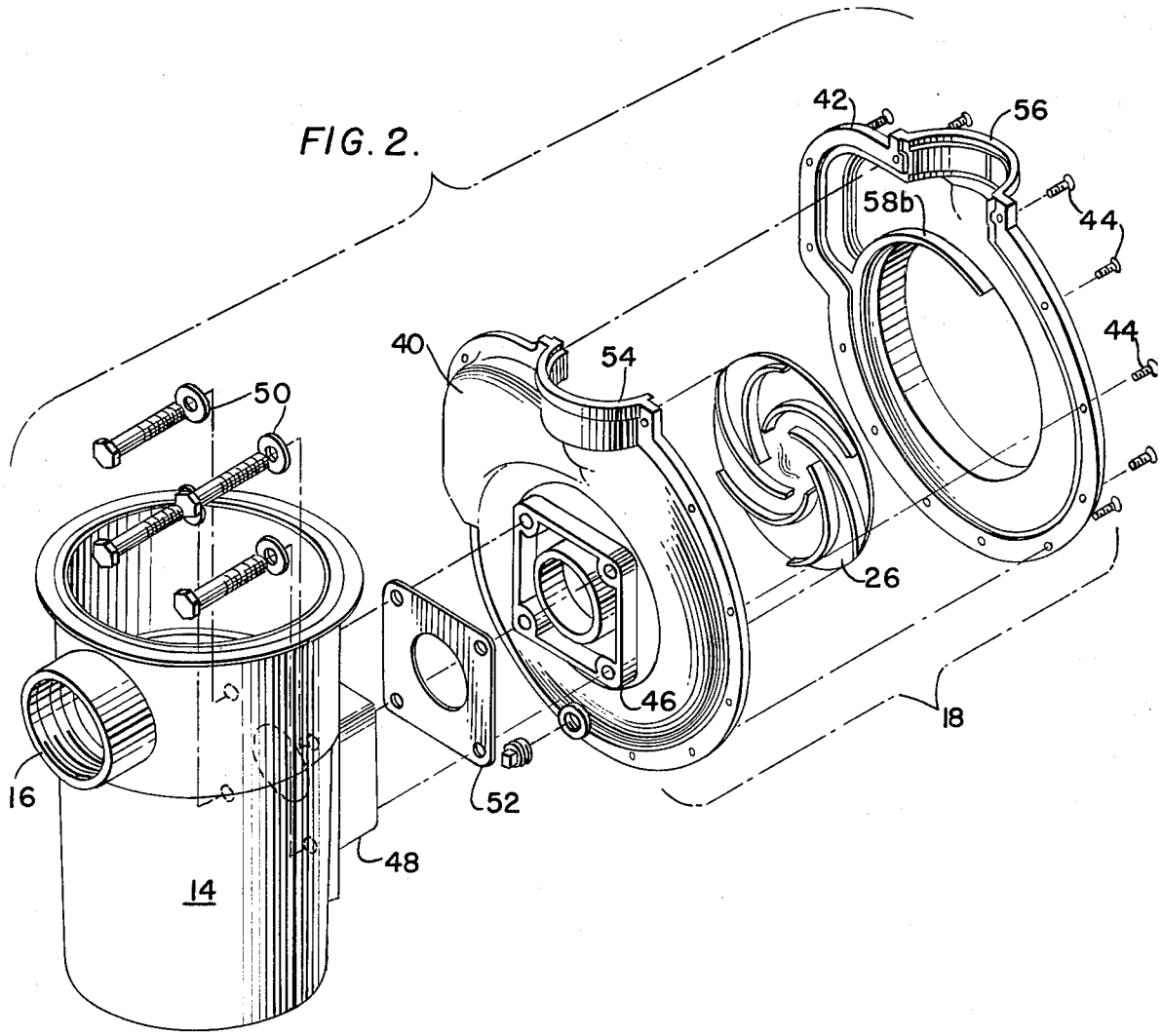
FIG. 2 is an exploded perspective view of a portion of the assembly of FIG. 1.

Referring specifically to FIGS. 2 and 3, the volute housing is formed by two molded casings 40 and 42 which are joined along a vertical plane as viewed in FIG. 1 to form the housing. The casings 40 and 42 are affixed together by a plurality of screws 44 extending through openings formed in outer peripheral flange portions of each member, it being understood that a synthetic sealing agent may be applied to the interface between the two members during assembly to provide a proper seal. The front casing 40 has a central opening surrounded by a mounting flange, or boss, 46 which has four openings extending therethrough which register with four openings formed through a boss 48 formed on the rear face of the housing 14. Four bolts 50 extend through the above openings to fasten the casing 40 to the housing 14, with a gasket 52 being interposed between the bosses 46 and 48. An opening is formed through the rear face of the housing 14 and the boss 48 to connect the interior of the housing 14 with that of the volute housing 18.

Semi-circular openings 54 and 56 are formed on the casings 40 and 42, respectively, which together form the discharge port 20 when the casings are joined together.

Referring specifically to FIGS. 3 and 4, arcuate-shaped ribs **58*a* and 58*b* are molded integral within the casings 40 and 42, respectively, and, when the latter portions are joined together, abut to form a cutwater, which together with the interior upper portion of the casings 40 and 42 define a priming chamber 60. In a similar manner, an additional cutwater is defined within the volute housing 18 by ribs 62*a* and 62*b* molded integral within the casings 40 and 42, respectively, which also abut when the casings are joined together. The latter cutwater functions to create a low pressure zone in the volume housing 18** to assist in priming.

Referring to FIG. 5, a volute housing is shown which is similar to the one previously described but is provided with two optional features. In particular, the housing is shown in general by the reference numeral 64 and comprises two casings 66 and 68 which are formed similarly to the casings 40 and 42, respectively, of the previous embodiment. However, in the embodiment of FIG. 5, an internally threaded inlet boss 70 is provided on the front face of the casing 66 for attachment to the housing 14, it being understood that a corresponding externally threaded outlet boss (not shown) will be provided on the back face of the latter housing to enable the two members to be assembled together.

An additional optional feature shown in the embodiment of FIG. 5 is the provision of a molded synthetic threaded insert 72 which extends within the discharge port defined by the two cooperating casings 66 and 68. The insert 72 rests on an internal shoulder formed by the casings 66 and 68 and is internally threaded so as to receive corresponding externally threaded discharge piping.

It is thus seen that, in accordance with all of the above embodiments of the present invention, an effective insulating barrier is provided between the electric motor 10 and the liquid flowing through the housings 14 and 18, with this being achieved while forming the critical components of the assembly of a synthetic dielectric material without any compromises in the exact design desired.

It is understood that the dielectric synthetic material used in connection with the housings 14 and 18, the basket 24, the impeller 26, the seal plate 30, and the insert 72 can be of several known types, such as a fiberglass reinforced plastic, or other equivalent material.

Of course, other variations of the specific construction and arrangement of the assembly disclosed above can be made by those skilled in the art without departing from the invention as defined in the appended claims.

We claim:

1. A pumping assembly comprising a casing formed of a molded synthetic material and divided substantially symmetrically about a vertical plane extending through the center thereof, said casing comprising a first casing portion having an axially extending volute rib, a second casing portion having an axially extending volute rib abutting said first volute rib in said vertical plane, and means for fastening said casing portions together, said casing portions and said ribs together defining a priming chamber portion and an impeller chamber portion, one of said casing portions defining an inlet opening and said casing portions together defining an outlet opening for permitting the flow of fluid into and from said casing; impeller means disposed in said impeller chamber portion for forcing water into said inlet opening, through said casing, and out said outlet opening; and drive means extending through an opening in said casing and operatively connected to said impeller means.

2. The assembly of claim 1, further comprising a seal plate of a dielectric material extending within the opening in said casing through which said drive means extends, said seal plate defining an opening for receiving said drive means, and seal means cooperating with said drive means and said seal plate for preventing the leakage of fluid from said housing.

3. The assembly of claim 2, wherein an outer surface of said seal plate engages the wall of said casing portion defining said opening.

4. The assembly of claim 2, further comprising a molded insert of a dielectric material disposed in said outlet opening.

5. The assembly of claim 2, further comprising a main housing and means for connecting said main housing to one of said casing portions.

6. The assembly of claim 5, wherein said connection means comprises a boss extending from said housing and from said one casing portion, said bosses together defining a passage connecting the interior of said housing with said impeller chamber portion.

7. The assembly of claim 5, wherein said connection means comprises a threaded inlet boss provided on said one casing member for threadedly engaging said housing and defining a passage connecting the interior of said housing with said impeller chamber portion.

8. The assembly of claim 7, wherein said inlet opening extends in an axial direction relative to said impeller chamber portion and wherein said outlet opening extends in a radial direction relative to said impeller chamber portion.

9. The assembly of claim 1, wherein each of said casing portions has a mounting flange extending outwardly therefrom and wherein said fastening means comprises a plurality of bolts extending through corresponding openings in said flanges to seal said fluid within said chamber.

* * * * *